US009365997B2

(12) United States Patent
McMillan

(10) Patent No.: US 9,365,997 B2
(45) Date of Patent: Jun. 14, 2016

(54) MODIFIED STONE COLUMN DRILL

(71) Applicant: Jaron Lyell McMillan, Canterbury (NZ)

(72) Inventor: Jaron Lyell McMillan, Canterbury (NZ)

( * ) Notice: Subject to any disclaimer, the term of this patent is extended or adjusted under 35 U.S.C. 154(b) by 0 days.

(21) Appl. No.: 14/648,263

(22) PCT Filed: Dec. 10, 2013

(86) PCT No.: PCT/IB2013/060759
§ 371 (c)(1),
(2) Date: May 29, 2015

(87) PCT Pub. No.: WO2014/091395
PCT Pub. Date: Jun. 19, 2014

(65) Prior Publication Data

US 2015/0322641 A1 Nov. 12, 2015

(30) Foreign Application Priority Data

Dec. 10, 2012 (NZ) ..... 604234

(51) Int. Cl.

| | |
|---|---|
| ***E02D 27/12*** | (2006.01) |
| ***E02D 3/08*** | (2006.01) |
| ***E02D 5/56*** | (2006.01) |
| ***E02D 3/12*** | (2006.01) |

(52) U.S. Cl.
CPC .. *E02D 3/08* (2013.01); *E02D 3/12* (2013.01); *E02D 5/56* (2013.01); *E02D 27/12* (2013.01)

(58) Field of Classification Search
CPC ..... E02D 27/12; E02D 3/08; E02D 3/12; E02D 5/56
See application file for complete search history.

(56) References Cited

U.S. PATENT DOCUMENTS

| | | | | | |
|---|---|---|---|---|---|
| 3,303,656 | A * | 2/1967 | Landau | E02D 3/106 | 405/241 |
| 3,720,063 | A * | 3/1973 | Shono | E02D 3/106 | 405/50 |
| 3,766,741 | A * | 10/1973 | Hartzell | E02D 7/18 | 175/21 |
| 3,828,864 | A * | 8/1974 | Haverkamp | E02D 13/10 | 173/112 |
| 3,962,879 | A * | 6/1976 | Turzillo | E21B 10/44 | 405/236 |
| 4,487,524 | A * | 12/1984 | Shono | E02D 3/106 | 405/232 |
| 5,353,883 | A * | 10/1994 | Kattentidt | E02D 5/36 | 175/19 |

(Continued)

FOREIGN PATENT DOCUMENTS

| | | | |
|---|---|---|---|
| CN | 1136126 | A | 11/1996 |
| EP | 0741227 | A2 | 11/1996 |

*Primary Examiner* — Benjamin Fiorello
(74) *Attorney, Agent, or Firm* — Galbreath Law Offices, P.C.; John A. Galbreath

(57) ABSTRACT

A granular stone column drill which includes a first drill, a second drill and a displacement device, where—the first drill includes a tube within which the second drill at least partially, co-axially, lies; —the second drill includes a drill flight and first terminal end; —the displacement device includes a displacement unit and at least one guidance means; —the displacement unit includes a guide channel and an exposed wall such that the guide channel extends into the exposed wall; —the exposed wall lies approximately parallel to a centerline of the second drill; and—the at least one guidance means are located within the guide channel; such that the guide channel is a continuous circumferential channel that follows a wave like path, and either the at least one guidance means or the displacement unit is releasably or permanently attached to the second drill.

19 Claims, 9 Drawing Sheets

(56) References Cited

U.S. PATENT DOCUMENTS 5,875,860 A * 3/1999 Coelus ..... E02D 5/36 175/323
6,142,711 A * 11/2000 Goughnour ..... E02D 7/18 405/182
6,478,512 B2 * 11/2002 Sherwood ..... E02D 5/34 175/323
6,663,321 B1 * 12/2003 Bisschops ..... E02D 5/46 175/20
7,677,839 B2 * 3/2010 Stoetzer ..... E02D 3/08 173/145
7,713,002 B2 * 5/2010 Stoetzer ..... E02D 3/08 175/308
8,657,034 B2 * 2/2014 Leuchtenberg ..... E21B 21/08 175/25
9,068,409 B2 * 6/2015 Mohamed ..... E21B 7/002
2003/0123937 A1 * 7/2003 Landau ..... E02D 3/08 405/233
2015/0176238 A1 * 6/2015 Stroyer ..... E02D 5/36 405/233

* cited by examiner

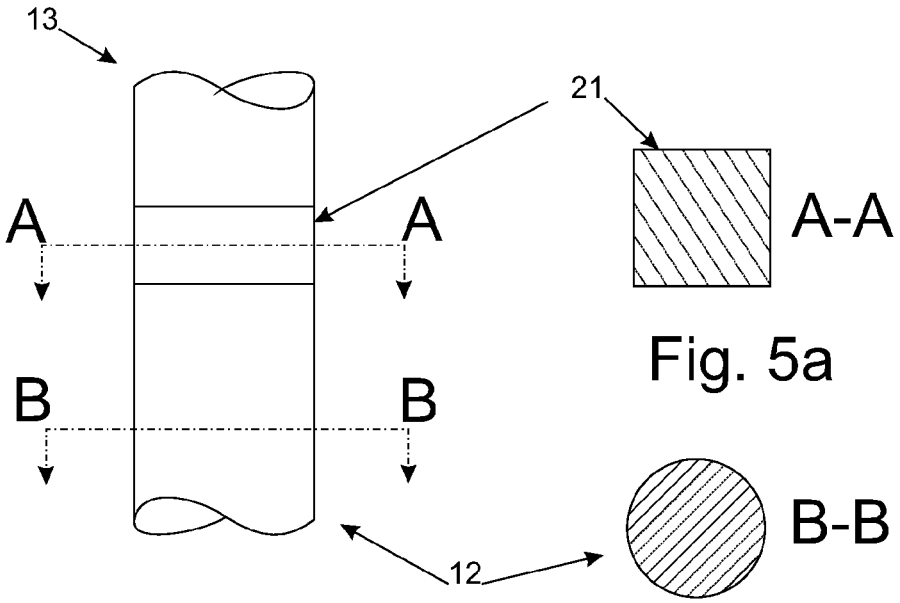
Fig. 5
Fig. 5a
Fig. 5b
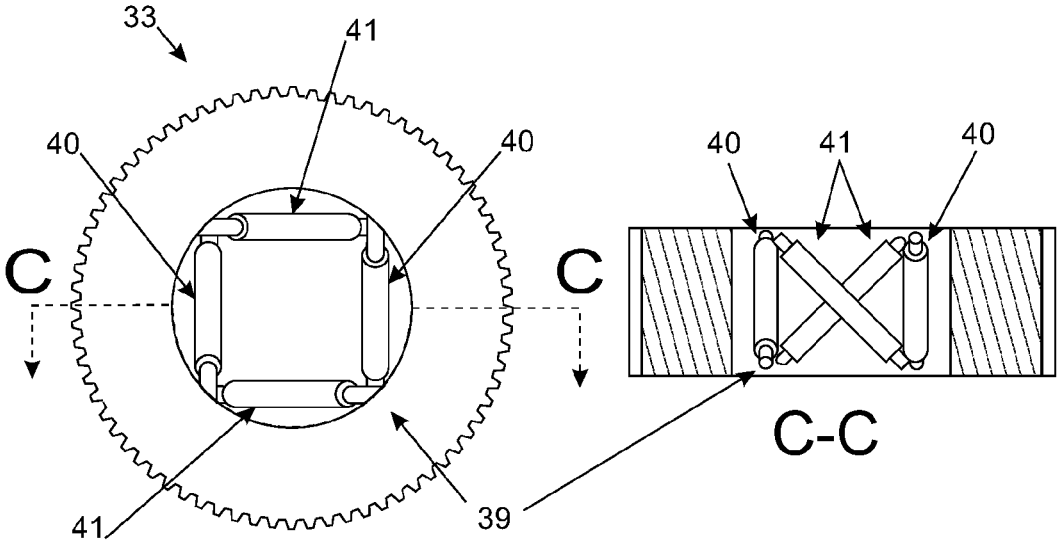
Fig. 6
Fig. 6a

D-D

E-E

MODIFIED STONE COLUMN DRILL

TECHNICAL FIELD

The present invention relates to modifications to a drill used to form in ground piles for supporting buildings or other structures.

BACKGROUND ART

Any discussion of the prior art throughout the specification is not an admission that such prior art is widely known or forms part of the common general knowledge in the field.

The formation of in ground granular stone columns can be accomplished by a number of means, one means uses a drill which includes an auger within a hollow tube. When the drill is at the desired depth the aggregate is fed into the centre of the hollow tube and the auger rotated to form the granular stone column. As the aggregate is a granular material it can bridge and partially or completely block the flow of aggregate into the stone column. To overcome this bridging it is possible to manually clear this bridging but this can be time consuming and can affect the quality of the granular stone column formed.

To minimise bridging and allow the drill to be more easily extracted from the ground as the granular stone column is formed the auger can be driven in the opposite direction to the hollow tube. One method proposed for this uses an epicyclic gear, with the auger permanently attached to the sun gear and the annulus (annular gear) driven. In some variations, to prevent the auger being continuously driven, the sun gear is disengaged from the planetary gears. If the sun gear is disengaged during the initial drilling it needs to be properly aligned then engaged with the planetary gears before the granular column can be formed, this can be time consuming and if misaligned with power applied it could damage or break the teeth or gears. It should be noted that the reverse direction of the auger and the hollow tube still bridges, this bridging then needs to be cleared before continuing.

In addition to the bridging problems that can increase the time taken to prepare a granular stone column there is also a need to compact the aggregate during formation of granular stone column. The feed rate of aggregate, rpm of the drills and extraction rate of the drill from the ground can all be varied, but even then it can be difficult to achieve the required compaction. To improve compaction the completed stone column can be mechanically vibrated, but this is an additional step.

In some ground environments the drill can 'stick' during extraction which can increase the time taken to form each granular stone column, or in some cases require additional machinery to clear.

It is an object of this invention to overcome or mitigate one or more of the deficiencies highlighted above, and/or to at least provide the consumer with a useful choice.

DISCLOSURE OF INVENTION

The present invention provides a granular stone column drill which includes a first drill, a second drill and a displacement device, where the first drill includes a tube within which the second drill at least partially, co-axially, lies;

the second drill includes a drill flight and first terminal end;

the displacement device includes a displacement unit and at least one guidance means;

the displacement unit includes a guide channel and an exposed wall such that the guide channel extends into the exposed wall;

the exposed wall lies approximately parallel to a centreline of the second drill; and the at least one guidance means are located within the guide channel;

such that the guide channel is a continuous circumferential channel that follows a wave like path, and either the at least one guidance means or the displacement unit is releasably or permanently attached to the second drill.

Preferably the guide channel follows a smooth wave like path. In a highly preferred form the guide channel is approximately sinusoidal.

Preferably the guide channel is between 1 and 100 wavelengths in length. Preferably the number of wavelengths is between 1 and 10.

In an alternative preferred form the guide channel is made up of a plurality of partial waves or a superposition of waveforms. Preferably the guide channel is made up of one or more of the following:—different wavelengths, different waveforms, waves with different peak to trough dimensions, non-sinusoidal wave forms, sinusoidal waveforms, discontinuities and whole wavelengths.

In a further form the guide channel is a superposition of two or more separate subsidiary waveforms, each subsidiary waveform having a different wavelength and/or peak to trough distance.

Preferably the guide channel has a peak to trough distance of between 1 mm and 400 mm. In a highly preferred form the peak to trough distance is 25 mm to 100 mm. In a still more preferred form the peak to trough distance is 50 mm.

Preferably the granular stone column drill includes a gearbox which is attached to or adapted to be driven by the first drill, such that the second drill includes a drive section and the gearbox includes an engagement section, where the drive section and engagement section are adapted to co-operate to transfer rotational motion in the first drill to the second drill, or from a rotary head to the first and/or second drill.

Preferably the drive section includes a pair of parallel opposing first sides and the second drill includes a shaft, and the engagement section includes at least one pair of first contact means, such that the distance between said first sides is the same as the diameter said shaft, and the distance between said first contact means is also the same as the diameter of said shaft. Preferably the engagement section includes a parallel pair of second contact means and the drive section includes a pair of parallel opposing second sides. Preferably the second sides and second contact means are dimensioned similarly to the first sides and first contact means respectively.

Preferably the contact means are selected from a surface, an extended rotatable member a combination of these. In a highly preferred form each contact means is a cylindrical roller or wheel. In an alternative preferred form the contact means are surfaces or strips of one or more materials selected from bronze, a low friction metal, a low friction polymer and a low friction ceramic; noting that the low friction properties may come from a lubricant or be an inherent property of the material used. In a preferred form the cross section of the engagement section is a polygon with the contact means forming the sides of the polygon.

In an alternative form the drive section is essentially rectangular, or preferably essentially square in cross section and includes at least one drive unit extending from each face of the drive section, Preferably the engagement section includes a first aperture which has a cross section that is the combination of a cross with all arms equal in length and a circle, where the cross and the circle are concentric. Preferably the arms of the cross form four drive channels dimensioned to accept at least one drive unit.

Preferably each drive unit can rotate freely about a centre-line that is approximately perpendicular to the face from which it extends.

Preferably the engagement section is a socket for the drive section. Preferably each drive unit is selected from a surface, an extended rotatable member a combination of these. In a highly preferred form each drive unit is a cylindrical roller or wheel. In an alternative preferred form one or more drive unit is a surface or strip of one or more materials selected from bronze, a low friction metal, a low friction polymer and a low friction ceramic; noting that the low friction properties may come from a lubricant or be an inherent property of the material used.

The present invention also includes a preferred method of forming a granular stone column which includes the following steps in order:

- a first or insertion step where the granular stone column drill is inserted into the ground;
- a second step where the engagement section and drive section are engaged and the gearbox drives the second drill;
- a third or formation step where the displacement device is engaged.

Preferably the gearbox includes an epicyclic gear set, and the engagement section forms part of a sun gear.

Preferably the drive section is quadrilateral in cross section. Preferably the quadrilateral is a square. In an alternative form the cross section of the drive section is a regular polygon.

BRIEF DESCRIPTION OF DRAWINGS

By way of example only, a preferred embodiment of the present invention is described in detail below with reference to the accompanying drawings, in which:

FIG. 5 is a side view of the portion of the second drill that includes the drive section;

FIG. 5*a* cross sectional view A-A through the shaft of the second drill;

FIG. 5*b* cross sectional view B-B through the drive section of the second drill;

FIG. 6 plan view of the sun gear with the engagement section;

FIG. 6*a* cross sectional view C-C through the sun gear with the drive socket;

DEFINITIONS

Aggregate: when used herein is construction aggregate above about 0.1 mm in size (including sand, stones, crushed rock, crushed concrete, slag, etc).

Auger: when used herein includes a flight without a central shaft, similar to a corkscrew.

Flight: when used herein is a strip of material following a helical path like a spiral staircase.

Tube: when used herein a tube is meant to indicate a long hollow member whose outer cross sectional profile may be circular or any other shape (triangular, square, hexagonal, elliptical, etc) and whose inner cavity is circular (or approximately circular/elliptical) in cross section.

Please note the drawings are representative only and the relative dimensions may be exaggerated for clarity.

First Embodiment of the Invention

Figure 1:
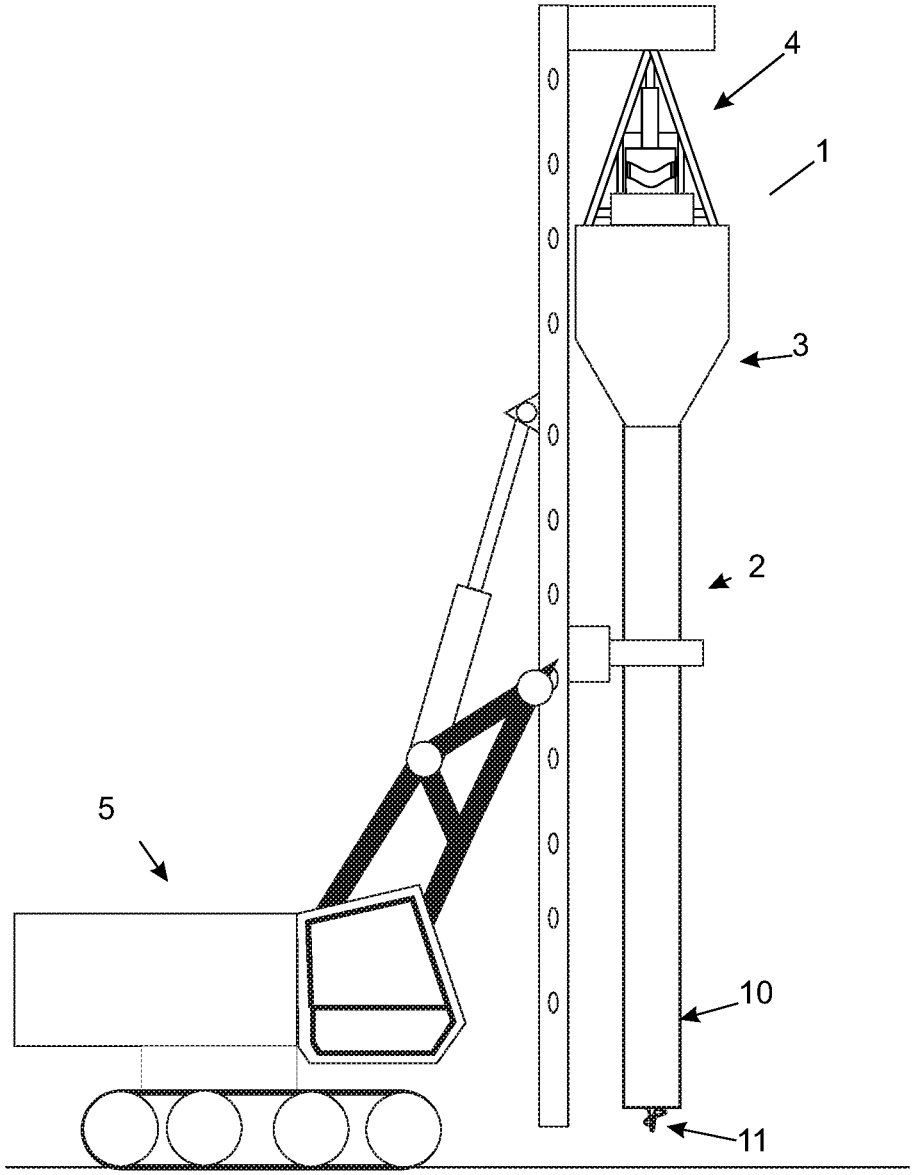
FIG. 1 is a pictorial view of a drill assembly for forming in ground granular stone columns attached to a drilling rig.

Referring to FIG. 1 a first embodiment of a column assembly (1) including a drill assembly (2), a hopper (3) and a support (4) is shown. The column assembly (1) in use is attached to a crane or excavator (5). The crane/excavator (5) is of a known type used in the industry and it provides the support and services to the column assembly (1).

The drill assembly (2) includes a first drill (10) and a second drill (11) and is used for forming in ground granular stone columns.

Figures 2, 2A, 2B:
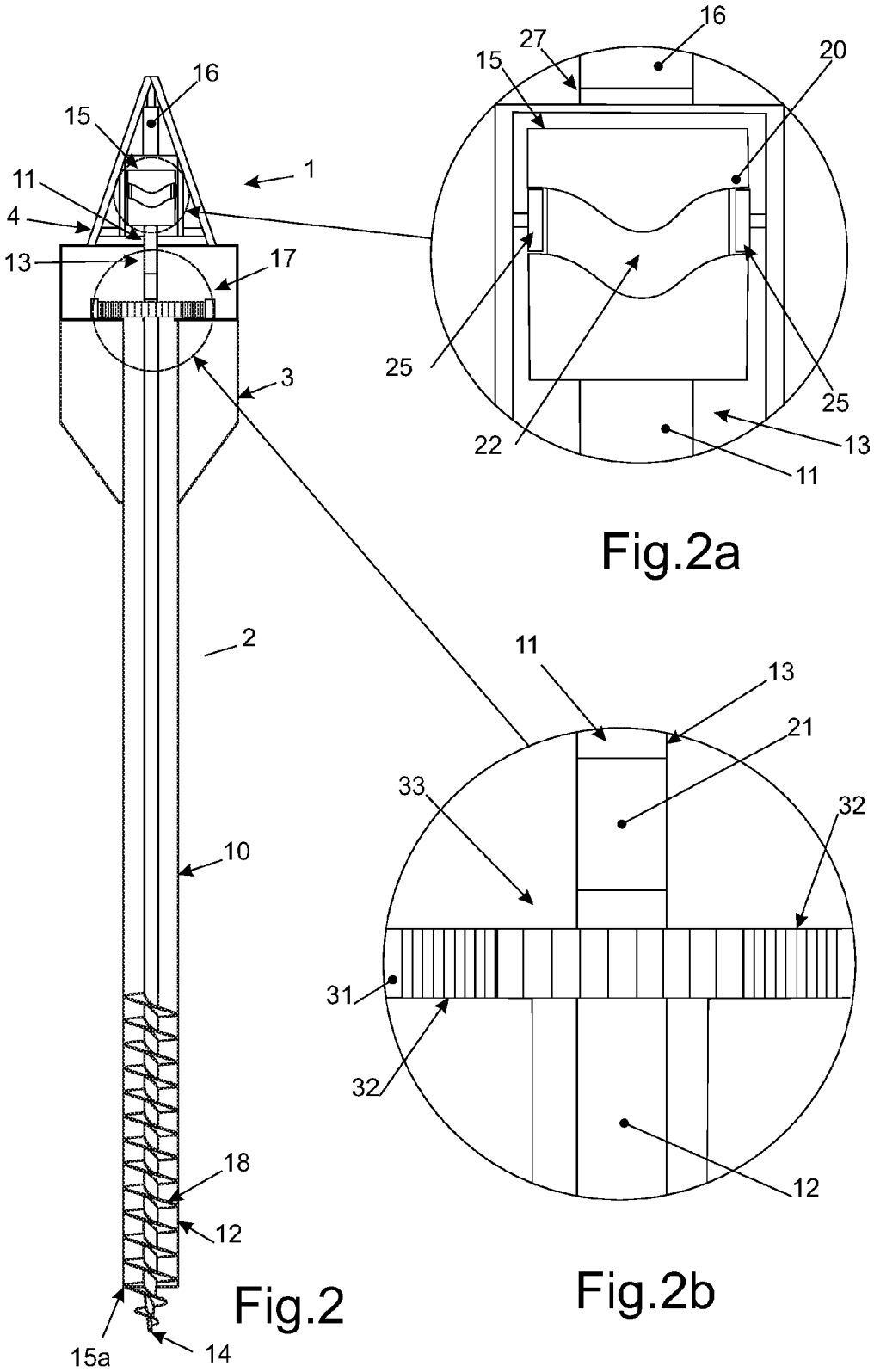
FIG. 2 is a cross sectional side view of the drill assembly and the support frame.
FIG. 2*a* is an enlarged section of FIG. 2 showing the optional displacement unit in more detail.
FIG. 2*b* is an enlarged section of FIG. 2 showing the epicyclic gear and optional drive section in more detail.

Referring to FIG. 2 the column assembly (1) is shown in cross section. The first drill (10) is essentially a hollow tube with the second drill (11) lying coaxially aligned, and at least partially within, said first drill (10).

The second drill (11) includes a primary section (12) and a secondary section (13), where one terminal end of the primary section (12) is coterminous with a first terminal end (14) of the second drill (11), and one terminal end of the secondary section (13) is coterminous with a second terminal end (15) of the second drill (11). The first terminal end (14) and second terminal end (15) are the opposite terminal ends of the second drill (11). The primary section (12) is the end of the second drill (11) that is located closest to the primary end (15*a*) of the first drill (10), where the primary end (15*a*) is the open terminal end of the first drill (10) that enters the ground first.

The hopper (3) is a container for the aggregate to be used to form the granular column. In this case it is essentially a truncated cone with a cylindrical section extending from the cone's base, the truncated end forming the base of the hopper (3).

The column assembly (1) further includes a movement device (16) and a gearbox (17). Where the movement device (16) is attached to the support (4) and indirectly to the secondary section (13) and/or second terminal end (15), and the gearbox (17) is configured or adapted to drive, when in use, either one or both drills (10,11).

The movement device (16) is most likely to be a pneumatic or hydraulic ram of known type, but, it could be any device that can move the second drill (11) longitudinally within the first drill (10).

The primary section (12) is an auger which includes a drill flight (18) one end of which is coterminous with the first terminal end (14). The drill flight (18) may extend along part or all of the length of the primary section (12).

For clarity two enlarged sections are shown as FIG. 2*a* and FIG. 2*b*, in FIG. 2*a* the second drill (11) includes, or is attached to, a displacement unit (20) and in FIG. 2*b* the secondary section (13) of the second drill (11) includes a drive section (21). The second drill (11) may include either, one of, or both, the displacement unit (20) and the drive section (21).

Figure 3:
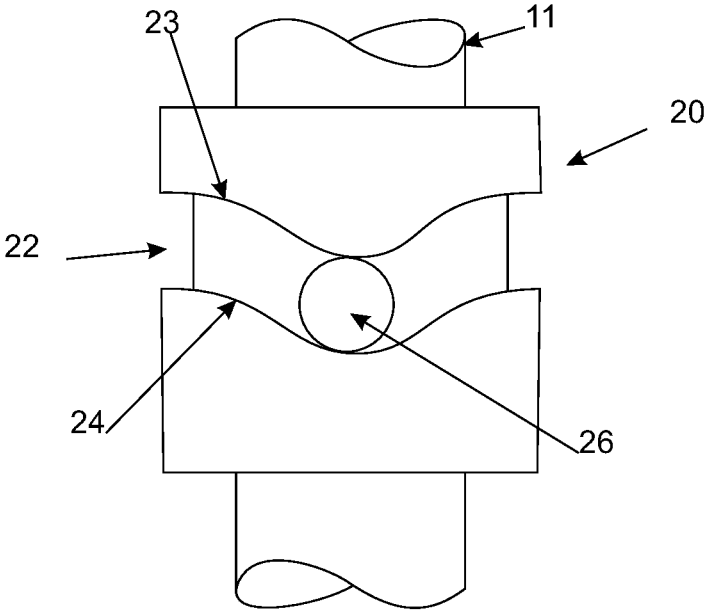
FIG. 3 is a side view of the displacement unit.

Referring to FIG. 2*a* and FIG. 3 a portion of the secondary section (13) of the second drill (11) with one variant of the displacement unit (20) is shown. In this variant the displacement unit (20) is rigidly connected to, or is formed as part of the secondary section (13) of the second drill (11). The displacement unit (20) may be permanently attached (welded onto the second drill (11) for example), formed as part of the second drill (11) or releasably attached (for example keyed and/or bolted to the second drill (11)).

In FIGS. 2*a* and 3 the displacement unit (20) is shown as a cylinder co-axially aligned with the second drill (11) which includes a guide channel (22). The guide channel (22) is a continuous circumferential channel in the surface of the displacement unit (20) that follows a smooth wave like path. The waveform of the guide channel (22) is likely to be approximately) sinusoidal (or the superposition of a plurality of approximately sinusoidal waveforms) and have a peak to trough distance of between 1 mm and 400 mm, though it is felt it will most likely be between 20 mm and 100 mm. The figures show a guide channel (22) two wavelengths in length, but this will likely depend on the rotational speed of the second drill (11), the size of the aggregate and the peak to trough distance of the guide channel (22). The length of the guide channel (22) will be at least 1 wavelength and likely fall within the range of between 1 and 10 wavelengths for most applications. It is felt that the waveform will consist of a whole number of waves of the same waveform and frequency but some applications may benefit from a variable waveform consisting of a number of partial or whole wavelengths of the same or different waveforms and/or frequencies. The guide channel (22) may also benefit from discontinuities. It should be noted that the waveform can be a superposition of different waveforms, where those superimposed waveforms have different frequencies and/or peak to trough heights. For example a wave with a periodicity of 1 with a peak to trough of 25 mm could be combined with a wave with a periodicity of 5 and a peak to trough of 1 mm, so the displacement unit imparts a slow large movement combined with a faster short displacement at the same time.

The guide channel (22) includes channel walls (23,24) that are the side walls of the guide channel (22).

The support (4) includes a retention structure (25) and guidance means (26), where the retention structure (25) is a framework designed to hold the guidance means (26) within the guide channel (22). In this case the guidance means (26) are freely rotating rollers or wheels of a known type that are dimensioned to fit between the channel walls (23,24) of the guide channel (22). It should be noted that the guidance means (26) may be any device that can move freely along the guide channel (22) between the channel walls (23,24), for example wheels, rollers, blocks of material, constructs with one or more low friction surfaces, constructs with balls or rollers contacting one or more of the channel walls (23,24), etc. One guidance means (26), in this case each is shown as a wheel, is located within the guide channel (22) on two diametrically opposed sides of the displacement unit (20).

In use the guidance means (26) operate cooperatively with the guide channel (22) to move the displacement unit (20) and the second drill (11) co-axially with respect to the first drill (10). This motion has been found to minimise or eliminate the bridging of the aggregate when the column assembly (1) is used in a manner similar to that described in PCT/IB2012/051585 for forming a granular stone column.

In other words, when the displacement unit (20) is in use, the second drill (11) rotates with the displacement unit (20) but the guidance means (2) remains in a fixed position attached to the retention structure (25). This means that as the second drill (11) rotates each guidance means (26) moves along the guide channel (22) parallel to one or both channel wall (23, 24). As the guidance means (26) moves along the length of the guide channel (20) the second drill (10) is co-axially displaced in relation to the first drill (10).

The speed and magnitude of the co-axial displacement between the first and second drill (10,11) is determined by the waveform of the guide channel (20) and as such this can be optimised for specific applications.

It should be noted that the guidance means (26) may be solid and formed of a low friction material (bronze, polytetrafluoroethylene, polymers, ceramics, etc) or be a device containing one or more rotating members that contact one or both of the channel walls (23,24). The guidance means (26) are dimensioned and designed to act co-operatively with the guide channel (22) to move the displacement unit (20) and the second drill (11) to which they are attached, or formed as part of, co-axially with respect to the first drill (10).

As can be seen in FIG. 3 the second drill (11) may extend beyond the displacement unit (20), as such the second terminal end (15) is not necessarily co-terminous with the displacement unit (20).

Referring to FIGS. 2 and 2*a* it can be seen that the movement device (16) is indirectly connected to the second drill (11) by the guidance means (26), as these engage with but are not directly attached to the displacement unit (20). In addition the movement device (16) may include an isolator (27) to co-axially rotationally isolate the movement device (16) from the first drill (10) or second drill (11), this isolator (27) may be a bearing (roller/ball), bushes, or anything similar.

Figure 4:
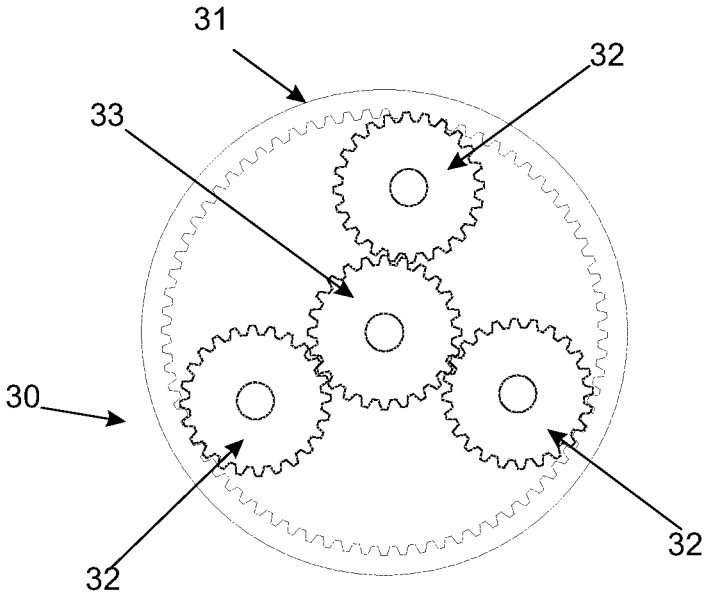
FIG. 4 is a plan view of an epicyclic gear.

Referring to FIG. 4 a standard epicyclic gear (30) is shown, the epicyclic gear (30) includes an annulus or ring gear (31), planetary gears (32) and a sun gear (33). The sun gear (33) is centrally located with, in this case, three planetary gears (32)

distributed evenly around and enmeshed with the sun gear (33). The annulus or ring gear (31) is a ring gear with the teeth on the inner surface, the annulus or ring gear (31) is meshed with all of the planetary gears (32).

The gearbox (17) shown in FIG. 2*b* includes an epicyclic gear set (30) with an annulus or ring gear (31), more than one planetary gears (32) and a sun gear (33).

Referring to FIG. 5 the section of the second drill (11) that includes the drive section (21) is shown in more detail. In this case the drive section (21) is located between the primary section (12) and the secondary section (13) of the second drill (11).

Referring to FIGS. 5, 5*a* and 5*b*, where FIG. 5*a* is a cross section of the drive section (21) in the direction of arrows A-A in FIG. 5, and FIG. 5*b* is a cross sectional view of the primary section (12) of the second drill (11) in the direction of arrows B-B in FIG. 5. In this case the cross section of the primary section (12) is circular and the same as the secondary section (13). The cross section, A-A, of the drive section (21) is a square with the distance between opposing faces equal to the diameter of the circular cross section, B-B, of the primary section (12).

Referring to FIG. 6 the sun gear (33) includes an engagement section (39). The engagement section (39) includes a pair of first contact means (40) and a pair of second contact means (41) is shown in plan view with the sun gear (33) lying on the x-y plane. Each contact means (40) is a cylindrical roller on a co-axial shaft.

In this view the first contact means (40) are parallel and the second contact means (41) are parallel but the first contact means (40) lie perpendicular to the second contact means (41). The distance between the pair of first contact means (40) is equal to the diameter of the primary section (12) with each first contact means (40) equidistant from the centre of the sun gear (33). Likewise the distance between the pair of second contact means (40) is equal to the diameter of the primary section (12) with each second contact means (40) equidistant from the centre of the sun gear (33). Noting that if cross-section A-A is not a square then the distance between respective pairs of contact means (40,41) will depend on the faces of the drive section (21) each pair of contact means (40,41) is intended to engage with.

FIG. 6*a* is a cross sectional view in the direction of arrows C-C through the sun gear (33). FIG. 6*a* is a cross sectional view of the sun gear (33) viewed in the x-z plane.

In FIG. 6*a* the first contact means (40) are parallel to each other and the centreline of the sun gear (33). In FIG. 6*a* the second contact means (41) are approximately perpendicular to each other and the centreline of the sun gear (33). Where the contact means (40,41) incorporates a long rotatable member (cylindrical roller in this case) to reduce friction, this rotatable member must be either parallel to, or angle with respect to, the centreline of the sun gear (33) to minimise scuffing. The optimum angle of the contact means (40,41) with respect to the centreline of the sun gear (33) will depend on the diameter of the contact means (40,41) and the diameter of the primary section (12).

Figure 7:
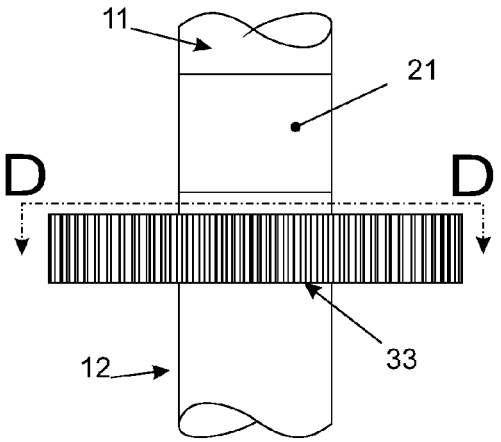
FIG. 7 side view of a portion of the second drill and sun gear with the drive section disengaged from the engagement section.
Figure 7A:
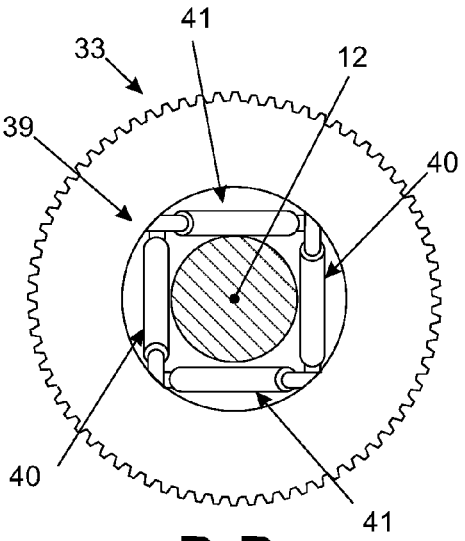
FIG. 7*a* cross sectional view D-D through the shaft of the second drill with the drive section disengaged from the engagement section.
Figure 8:
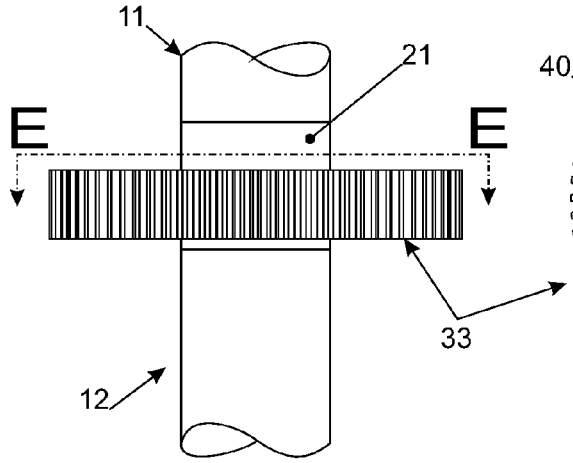
FIG. 8 side view of a portion of the second drill and sun gear with the drive section and engagement section engaged.
Figure 8A:
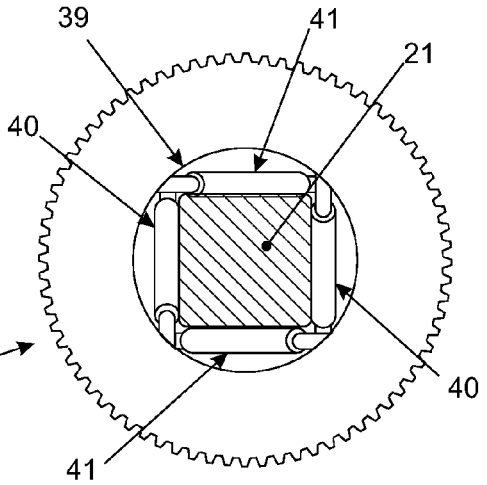
FIG. 8*a* cross sectional view E-E through the engagement section with the drive section and engagement section engaged.

One preferred means of using the drive section (21) is shown in FIGS. 7, 7*a*, 8 and 8*a*; where FIGS. 7*a* and 8*a* are cross section views in the direction of arrows D-D and E-E respectively.

In FIGS. 7 and 7*a* the drive section (21) is not engaged with the engagement section (39) and as such the sun gear (33) is free to rotate with respect to the second drill (11).

In FIGS. 8 and 8*a* the movement device (16) has moved the drive section (21) with respect to the sun gear (33). The drive section (21) and engagement section (39) now co-operate to transfer the rotation of the sun gear (33) to the second drill (11) or vice versa, depending on which is being driven.

When forming a granular stone column the drill assembly (2) is rotated and inserted into the ground during insertion it may be desirable to keep the first and second drills (10,11) rotating the same way. When the drill assembly (2) reaches the required depth the aggregate forming the granular stone column needs to be fed to the base of the drill assembly as the drill assembly (2) is removed. In this case it may be desirable to rotate the first and second drills (10,11) in opposite directions. If the second drill (11) incorporates the drive section (21) and a sun gear (33) with the engagement section (39) is used this opposite rotation can be easily accomplished. Without the engagement section (39) and drive section (21) present two separate drive means, one for each drill (10,11), are likely to be required.

In further embodiments the gearbox may not be an epicyclic gearbox but the engagement section (39) may still be present in one of the gears.

In alternative embodiments (not shown) the cross section A-A need not be square it can be any polygon where the distance between at least one pair of opposing parallel faces is equal to the diameter of the primary section (12). For example the cross section A-A could be a regular hexagon, a rectangle or any other suitable shape.

In further embodiments (not shown), where contact means (40) are present the contact means (40) may simply be the inner walls of a socket that is internally dimensioned to engage with the drive section (21). In this case the contact means (40) could be bronze or a self lubricating, and/or low friction, solid material (metal, polymer or ceramic for example).

In further embodiments (not shown), where the contact means (40) are present they may simply be blocks or strips of suitable material, in this case they are likely to be a self-lubricating and/or low friction material, such as bronze, a polymer or a ceramic. Alternatively each contact means (40) may simply include one or more rotating member that contacts the surface of the primary section (12) or drive section (21).

In a further embodiment (not shown), where a displacement unit (20) is present, the guide channel (22) could be formed into a ring of material attached to the retention structure (25) and the guidance means (26) attached to the second drill (11). The guidance means (26) would still move along the guide channel (22) but they would rotate with the second drill (11) whenever it was being driven rather than remain static with regards to the column assembly (2).

BEST MODE OF CARRYING OUT THE INVENTION

Figure 9A:
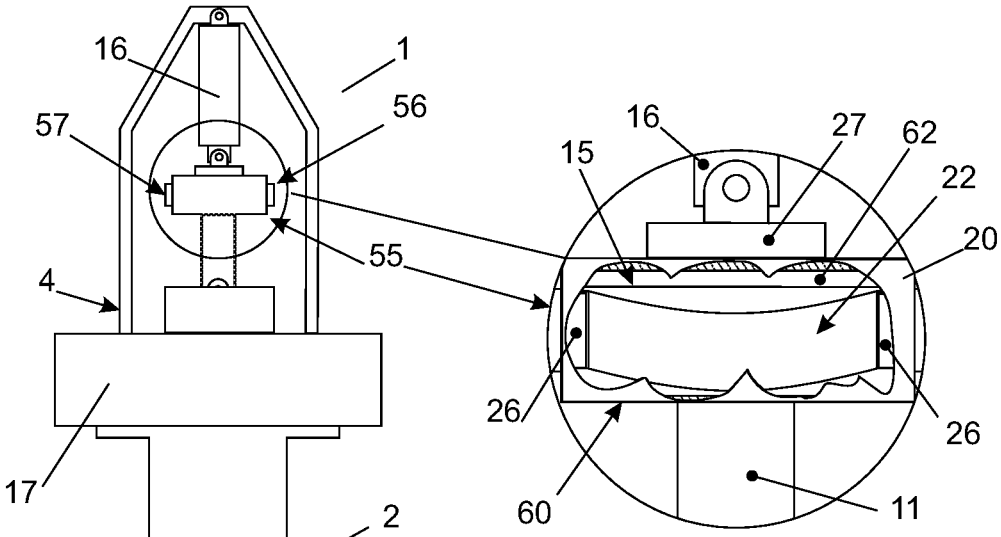
FIG. 9*a* is an enlarged view of a first variation of the displacement unit of the second embodiment.
Figure 9:
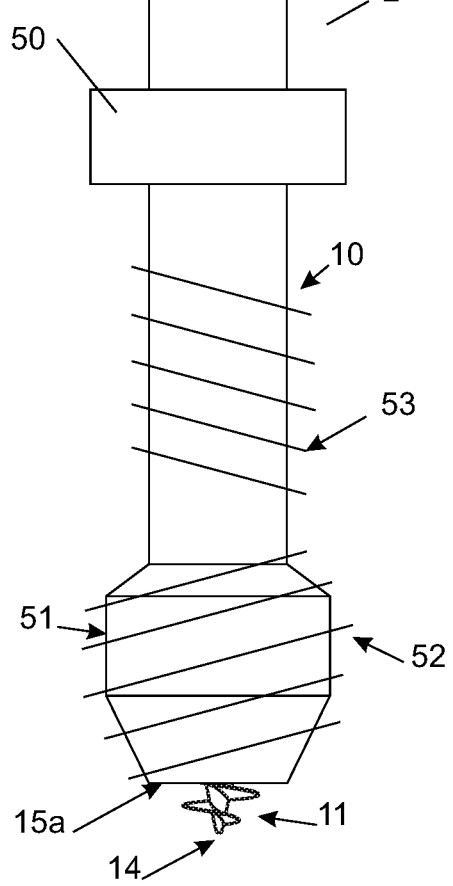
FIG. 9 is a side view of a second embodiment of the column assembly without hopper or crane excavator.

Referring to FIG. 9 a second embodiment of the column assembly (1) is shown with the hopper (3) and the crane excavator (5) removed for clarity. In this case a rotary head (50) of known type is shown, this rotary head (50) is configured to rotate the first drill (10).

In this second embodiment the first drill (10) includes an expanded section (51) located close to or at the primary end (15*a*). The expanded section (51) is essentially two truncated cones separated by a cylindrical section, where the bases of the cones are coterminous with the ends of the cylinder.

FIG. 9 shows optional alpha and beta first flights (52, 53), which are flights on the outside of the first drill (10). The alpha and beta first flights (52, 53) may have the same handedness or opposite handedness, and either may be the same handedness as the drill flight (18).

In FIG. 9 the displacement unit (20) is shown within a displacement device (55) with two engagement tabs (56, 57) extending from an outer casing (6). Where the outer casing encloses (60), at least partially, the moving parts of the displacement device (55).

Figure 9B:
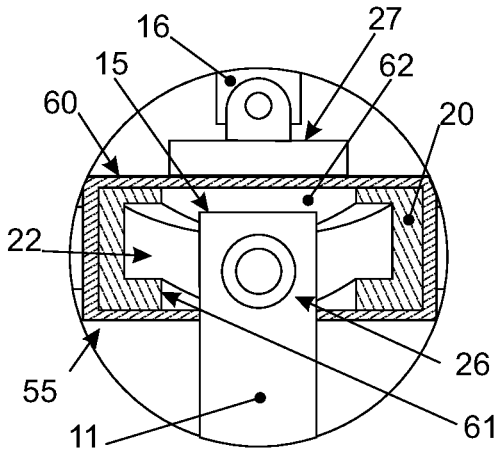
FIG. 9*b* is an enlarged view of a second variation of the displacement unit of the second embodiment.

Referring to FIGS. 9*a* and 9*b* an expanded view of two variations of the displacement device (55) are shown, with the interior exposed or in cross section for clarity. The displacement device (55) includes the displacement unit (20) and the guidance means (26) housed within the outer casing (60). In both variations the movement device (16) is attached to the outer case (60) by an isolator (27). The isolator (27) rotationally isolates (co-axially) the movement device (16) and outer case (60) which means the electrical, hydraulic or pneumatic connections to the movement device (16) do not need to account for this. As indicated in the first embodiment the isolator (27) is most likely to be a roller bearing, ball bearing, bush or similar, but anything that co-axially, rotationally, isolates the movement device (16) from the drills (10, 11), either directly or indirectly can be used.

The first variation of the displacement device (55) is shown in FIG. 9*a* and in this variation the displacement unit (20) is essentially the same as described for the first embodiment, with the guide channel (22) circumferentially cut into the outer surface of a cylinder attached to, or formed as part of, the second drill (11), but the guidance means (26) extend from an inner wall of the outer casing (60). It should be noted that the guidance means (26) may be attached to the outer casing (60) of the displacement device (20) directly or indirectly.

In FIG. 9*b* a second variation of the displacement device (55) is shown in cross section, in this second variation the guidance means (26) are attached to the surface of the second drill (11) and the displacement unit (20) is attached to or formed as part of the outer casing (60). In this second variation the displacement unit (20) is a ring with the guide channel (22) circumferentially cut into the inside wall (61).

There is a displacement space (62), which is a void, between the second terminal end (15) of the second drill (11) and the outer casing (60) to allow the second drill (11) to be displaced relative to the displacement (55) when the displacement device (55) is in use. The dimensions of the displacement space (62) are such that when in use the second drill (11) cannot contact the outer casing (60).

Figure 10:
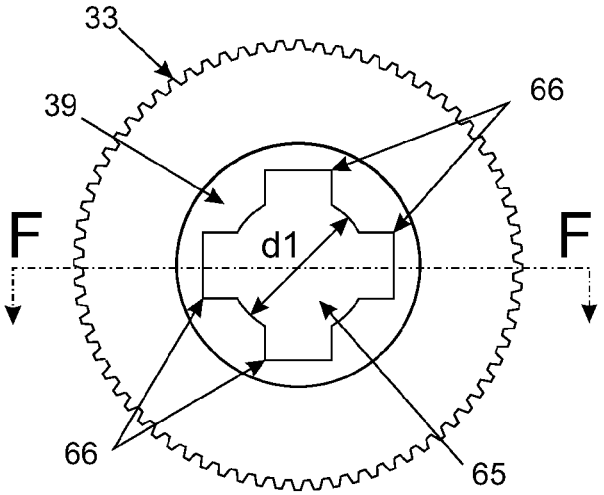
FIG. 10 is a plan view of the sun gear of the second embodiment.

In FIG. 10 the sun gear (33) with an engagement section (39) including a first aperture (65) is shown in plan view. In this second embodiment the first aperture (65) passes through the entire thickness of the sun gear (33). In this view the first aperture (65) is the combination of a cross with all arms equal in length and a circle, the centres of the cross, the circle and the sun gear (33) are coincident. The arms of the cross form four drive channels (66) through the sun gear (33). The diameter of the circle is d1.

Figure 12:
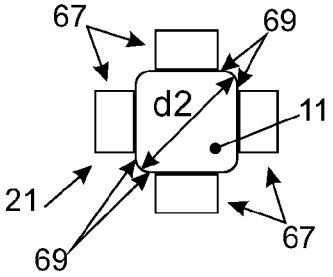
FIG. 12 is a cross sectional plan view, through G-G, of the secondary section of the second embodiment.
Figure 11:
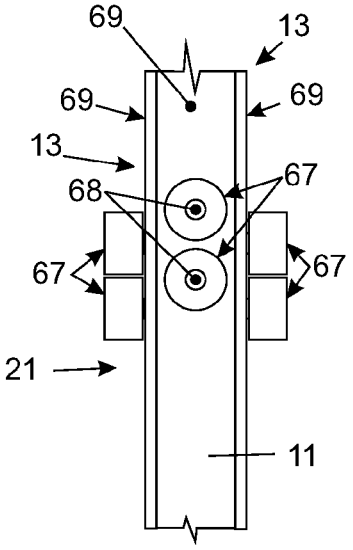
FIG. 11 is a partial side view of the secondary section of the second drill, including an alternative variant of the drive section. Of the second embodiment.

Referring to FIGS. 11 and 12 a portion of the secondary section (13) and a cross sectional view of the drive section (21) respectively, are shown. In this second embodiment the second drill (11) shaft in the drive section (21) is essentially square in cross-section with a maximum diagonal dimension of d2, where d2 is less than or at most equal to d1.

The drive section (13) further includes 4 pairs of drive units (67), where one drive unit (67) of each pair is located on diametrically opposed faces of the second drill (11) shaft to the other. Each drive unit (67) is a wheel or roller configured to rotate on a drive rod (68) to which it is attached. Each drive rod (68) is a shaft that extends approximately perpendicularly from a face (69) of the drive section (21). In some cases the drive rod (68) will extend through the second drill (11) shaft joining pairs of drive units together.

There are two drive units (67) shown located on each face of the drive section (21), these are spaced apart along the length of the drive section (21). The centreline of each drive rod (68) is perpendicular to, and passes through the centreline of the second drill (11).

Figure 13:
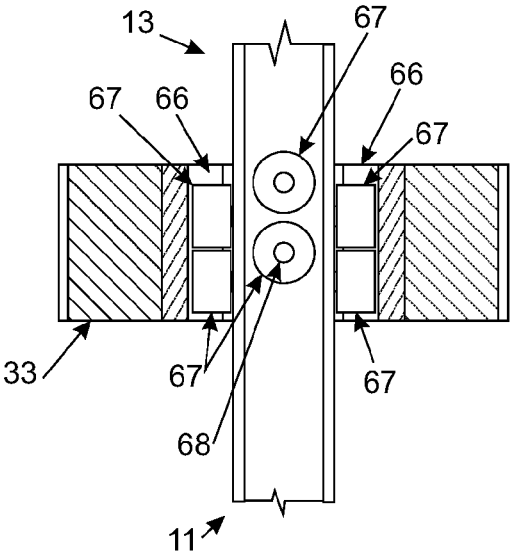
FIG. 13 is a cross sectional view of the sun gear of the second embodiment with the an alternative variant of the drive section engaged.

FIG. 13 shows a cross sectional view of the sun gear (33) and drive section (21) of the second embodiment engaged in the drive position. In the drive position the sun gear (33) can rotationally drive the second drill (11).

In the drive position the drive units (67) have been pushed into a complementary drive channel (66), as such each drive unit (67) is dimensioned to fit within the associated drive channel (66).

One preferred method of using the second embodiment will now be described with reference to FIGS. 14, 15 and 16 where the column assembly (1) is shown with the hopper (3) and the crane excavator (5) removed for clarity.

Figure 14:
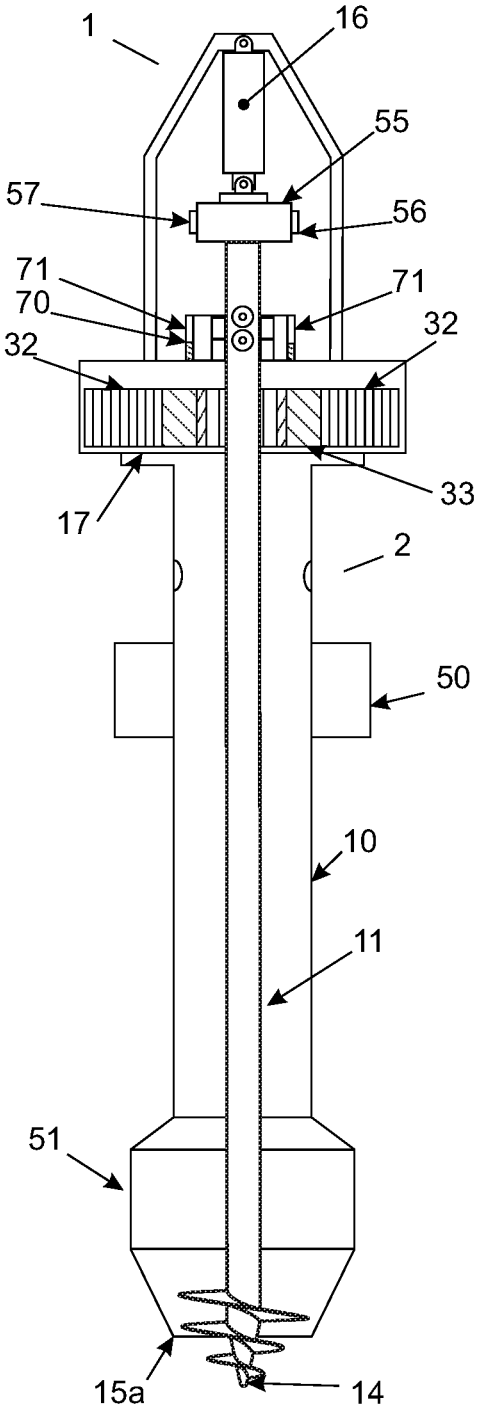
FIG. 14 is a partially cross sectional view of the second embodiment of the column assembly without hopper or crane excavator in a first (insertion) position.

In FIG. 14 the column assembly (1) is shown in a first or insertion position, where the displacement device (55) is disengaged and the second drill (11) is not being driven by the gearbox (17). In this position the drill assembly (2) is inserted into the ground to start the formation of a granular stone column, the first drill (10) is rotated by the rotary head (50) and it is forced into the ground. The second drill (11) may be stationary or rotated during this step (for example with the first drill (10)).

Located and attached to one side of the gearbox (17), the side closest to the movement device (16), is a lock device (70). The lock device (70) is a thick walled tube that lies co-axial with the second drill (11) which includes engagement apertures (71). Each engagement aperture (71) is a slot that extends into the lock device (70) that is dimensioned and configured to accept an engagement tab (56, 57).

When the drill assembly (2) is at the required depth and the stone column is to be formed the movement device (16) pushes the second drill (11) relative to the first drill (10). The movement device (16) then causes the first terminal end (14) to extend away from the primary end (15*a*).

Figures 15, 16:
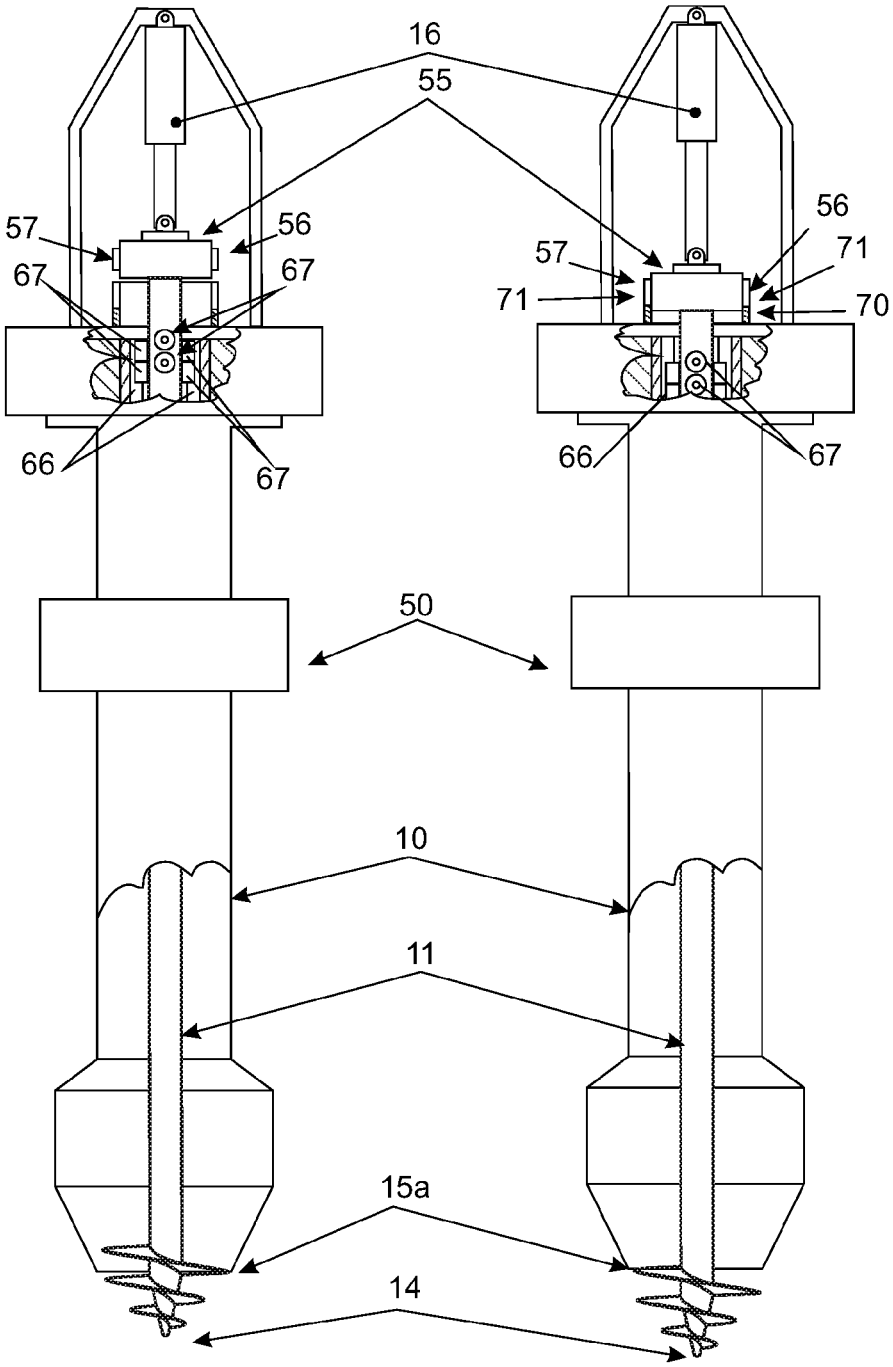
FIG. 15 is a partially cross sectional view of the second embodiment of the column assembly without hopper or crane excavator in a second position.
FIG. 16 is a partially cross sectional view of the second embodiment of the column assembly without hopper or crane excavator in a third (formation) position.

The movement device (16) continues to push the second drill (11) through the first drill (10) until, as shown in FIG. 15, the drive units (67) are engaged with the drive channels (66), in this second position the gearbox (17) can drive the second drill (11) to feed any aggregate within the first drill (10) out of the primary end (15*a*) to form a stone column as the drill assembly (2) is withdrawn from the ground.

In FIG. 16 the movement device (16) has pushed the second drill (11) into a third (formation) position, in this position each engagement tab (56, 57) has been pushed into full engagement with the complementary engagement aperture (71). The second drill (11) is also pushed further through the first drill (10), extending the first terminal end (14) still further from the drill assembly (2).

The displacement device (55) can now displace the first and second drills (10, 11) relative to each other as the drill assembly is withdrawn from the ground. The differential lengthwise motion of the second drill (11) relative to the first drill (10) minimises the chance of the aggregate bridging helping to produce a uniform quality stone column. The displacement device (55) is also believed to assist with the compaction of the stone column.

Though it is preferred that there are engagement tags (56, 57) on the displacement device (55) they are optional and an alternative method of engaging the displacement device (55) can be used.

In some embodiments (not shown) the drive channels (66) may have a different cross section, for example the cross section may be semi-circular. In this case the drive units (67) will have a complementary shape.

In some embodiments the drive units (67) are permanently attached to the associated drive rod (68) and this configured to rotate. In still other embodiments the drive units (67) are not configured to rotate, they act merely as drive keys.

Though the gearbox (17) is described as an epicyclic gearbox it can be any suitable form of gearbox (17) that allows the rotary head (50) to directly drive the first drill (10) and indirectly, via the gearbox (17), drive the second drill (11).

There are preferably two guidance means (26) present but in some cases there may be one, or more than two.

In use the guidance means (26) operate cooperatively with the guide channel (22) to move the displacement unit (20) or guidance means (26) and the second drill (11) co-axially with respect to the first drill (10).

KEY

1. Column assembly;
2. Drill assembly;
3. Hopper;
4. Support;
5. Crane excavator;
10. First drill;
11. Second drill;
12. Primary section (of second drill);
13. Secondary section (of second drill)
14. First terminal end;
15. Second terminal end;
15*a*. Primary end (of first drill);
16. Movement device;
17. Gearbox;
18. Drill flight;
20. Displacement unit;
21. Drive section (of second drill);
22. Guide channel;
23. Channel wall (side wall of guide channel);
24. Channel wall (side wall of guide channel);
25. Retention structure;
26. Guidance means;
27. Isolator (rotationally isolates movement device and displacement device);
30. Epicyclic gear set;
31. Annulus or ring gear;
32. Planetary gear;
33. Sun gear;
39. Engagement section;
40. First contact means;
41. Second contact means;
50. Rotary Head;
51. Expanded section (of first drill);
52. Alpha first flight;
53. beta first flight;
55. displacement device;
56. engagement tab (on enclosed displacement device);
57. engagement tab (on enclosed displacement device);
60. outer casing (of the enclosed displacement device)
61. inside wall (of displacement unit when it is a ring);
65. first aperture (cross shaped aperture through sun gear);
66. drive channels (through sun gear, second embodiment);
67. drive units (second embodiment);
68. drive rod (second embodiment connects pairs of drive units);
70. lock device (to engage with displacement device);
71. engagement aperture;

The invention claimed is:

1. A granular stone column drill which includes a first drill, a second drill and a displacement device, where the first drill includes a tube within which the second drill at least partially, co-axially, lies;

the second drill includes a drill flight and first terminal end;

the displacement device includes a displacement unit and at least one guidance means;

the displacement unit includes a guide channel and an exposed wall such that the guide channel extends into the exposed wall;

the exposed wall lies approximately parallel to a centreline of the second drill; and the at least one guidance means are located within the guide channel;

such that the guide channel is a continuous circumferential channel that follows a wave like path, and either the at least one guidance means or the displacement unit is releasably or permanently attached to the second drill.

2. A granular stone column drill as claimed in claim 1 wherein, the guide channel follows a smooth wave like path.

3. A granular stone column drill as claimed in claim 2 wherein, the guide channel is between 1 and 100 wavelengths, inclusive, in length.

4. A granular stone column drill as claimed in claim 2 wherein, the guide channel is made up of a plurality of partial waves or a superposition of waveforms.

5. A granular stone column drill as claimed in claim 4 wherein, the guide channel is a superposition of two or more separate subsidiary waveforms, each subsidiary waveform having a different wavelength and/or peak to trough distance.

6. A granular stone column drill as claimed in claim 2 wherein, the guide channel has a peak to trough distance of between 1 mm and 400 mm.

7. A granular stone column drill as claimed in claim 6 wherein, the peak to trough distance is 25 mm to 100 mm.

8. A granular stone column drill as claimed in claim 6 wherein, the peak to trough distance is 50 mm.

9. A granular stone column drill as claimed in claim 1 wherein, the guide channel is approximately sinusoidal.

10. A granular stone column drill as claimed in claim 1 wherein, the guide channel is between 1 and 100 wavelengths, inclusive, in length.

11. A granular stone column drill as claimed in claim 10 wherein, the number of wavelengths is between 1 and 10.

12. A granular stone column drill as claimed in claim 1 wherein, the guide channel is made up of a plurality of partial waves or a superposition of waveforms.

13. A granular stone column drill as claimed in claim 12 wherein, the guide channel is a superposition of two or more separate subsidiary waveforms, each subsidiary waveform having a different wavelength and/or peak to trough distance.

14. A granular stone column drill as claimed in claim 1 wherein, the guide channel has a peak to trough distance of between 1 mm and 400 mm.

15. A granular stone column drill as claimed in claim 14 wherein, the peak to trough distance is 25 mm to 100 mm.

16. A granular stone column drill as claimed in claim 15 wherein, the peak to trough distance is 50 mm.

17. A granular stone column drill as claimed in claim 14 wherein, the peak to trough distance is 50 mm.

18. A granular stone column drill as claimed in claim 1 wherein, the granular stone column drill includes a gearbox which is attached to, or adapted to be driven by, the first drill, such that the second drill includes a drive section and the gearbox includes an engagement section, where the drive section and engagement section are adapted to co-operate to transfer rotational motion in the first drill to the second drill or from a rotary head to the first and/or second drill.

19. A method of using the stone column drill as claimed in claim 1 which includes the following steps in order:

a first or insertion step where the granular stone column drill is inserted into the ground;

a subsequent or formation step where the displacement device is engaged.

* * * * *